US011594837B1

(12) United States Patent
Turner et al.

(10) Patent No.: US 11,594,837 B1
(45) Date of Patent: Feb. 28, 2023

(54) CONNECTOR ASSEMBLY FOR ELECTRICAL APPLIANCE AND SYSTEM AND METHOD INCLUDING SAME

(71) Applicant: Emerson Electric Co., St. Louis, MO (US)

(72) Inventors: Jesse N. Turner, Maryland Heights, MO (US); Mark J. Tomasiak, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 1 day.

(21) Appl. No.: 17/445,790

(22) Filed: Aug. 24, 2021

(51) Int. Cl.
*H01R 13/622* (2006.01)
*H01R 43/26* (2006.01)
*H01R 13/639* (2006.01)

(52) U.S. Cl.
CPC ..... *H01R 13/622* (2013.01); *H01R 13/6392* (2013.01); *H01R 43/26* (2013.01)

(58) Field of Classification Search
CPC ..... H01R 13/622; H01R 13/639; H01R 13/6392; H01R 13/6395; H01R 13/623; H01R 13/62; H01R 43/26
USPC ..... 439/350, 372, 369
See application file for complete search history.

(56) References Cited

U.S. PATENT DOCUMENTS 3,430,184 A * 2/1969 Acord ..... H01R 13/6335 439/255
3,452,316 A * 6/1969 Mocek ..... H01R 13/637 439/255
4,605,273 A 8/1986 Horton
5,344,333 A 9/1994 Haag
5,722,847 A 3/1998 Haag
6,350,139 B1 2/2002 Haag
6,358,076 B1 3/2002 Haag
6,609,924 B2 8/2003 Zeller et al.
2010/0105235 A1 * 4/2010 Friedrich ..... H01R 13/622 439/321
2018/0323537 A1 11/2018 Ma et al.

OTHER PUBLICATIONS

Autogeek ProLock Power Cord, Dec. 11, 2019, available at <https://www.youtube.com/watch?v=MH5F9lxiELc>.
Superior Electric YGA017-KIT 30 Amp 250 Volt Male Female Twist Lock 3 Wire Plug Nema L6-30P/30R, accessed Aug. 18, 2021, available at <https://www.amazon.ca/Superior-Electric-YGA017-KIT-Female-L6-30P/dp/B075DF5DRT>.
Hubbell Online Catalog, Section B, Twist-Lock® and Hubbellock® Devices, 2017, available at <https://hubbell.dcatalog.com/v/Hubbell-Wiring-Device-Kellems-Catalog/?page=72>.

* cited by examiner

*Primary Examiner* — Gary F Paumen
(74) *Attorney, Agent, or Firm* — Armstrong Teasdale LLP

(57) ABSTRACT

A connector assembly includes an electrical plug connectable to an electrical outlet, an inner collar, and an outer collar disposed radially outward from the inner collar. The inner collar includes a plurality of jaws disposed circumferentially about the electrical plug. Each jaw of the plurality of jaws includes threads defined along an outer surface of each jaw. The outer collar includes at least one thread defined along an inner surface of the outer collar. Rotation of the outer collar relative to the inner collar causes the at least one outer collar thread to rotatably engage the inner collar threads and the plurality of jaws to deflect inward such that the plurality of jaws engages and compresses the electrical outlet when the electrical outlet is connected to the electrical plug.

20 Claims, 15 Drawing Sheets

CONNECTOR ASSEMBLY FOR ELECTRICAL APPLIANCE AND SYSTEM AND METHOD INCLUDING SAME

FIELD

The field of the disclosure relates generally to electrical appliances, and in particular, to connector assemblies for user-worn electrical appliances.

BACKGROUND

Backpack vacuum cleaners are commonly used in commercial cleaning applications because of their convenience and versatility. Since backpack vacuum cleaners are designed for ease of movement around the space to be cleaned, they are often used with extension cords to provide a larger area of use. However, the vacuum power cord may be inadvertently disconnected from the extension cord during use, causing interruptions and delays in the cleaning process. The power cord may also be subjected to varying forces during use, which can result in excessive wear of the power cord or decreased service life if not properly managed.

Consequently, backpack vacuum cleaners often include a power cord restraint device to protect the power cord and prevent accidental disconnection. Many such devices employ unique or proprietary plugs and extension cords, and thus lack the flexibility to be used with more common or standard outlets and plugs.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a connector assembly includes an electrical plug connectable to an electrical outlet, an inner collar, and an outer collar disposed radially outward from the inner collar. The inner collar includes a plurality of jaws disposed circumferentially about the electrical plug. Each jaw of the plurality of jaws includes threads defined along an outer surface of each jaw. The outer collar includes at least one thread defined along an inner surface of the outer collar. Rotation of the outer collar relative to the inner collar causes the at least one outer collar thread to rotatably engage the inner collar threads and the plurality of jaws to deflect inward such that the plurality of jaws engages and compresses the electrical outlet when the electrical outlet is connected to the electrical plug.

In another aspect, a system includes an electrical appliance and a connector assembly. The electrical appliance includes an electrical plug configured to supply power to the electrical appliance when connected to an electrical outlet. The connector assembly includes an inner collar and an outer collar disposed radially outward from the inner collar. The inner collar includes a plurality of jaws disposed circumferentially about the electrical plug. Each jaw of the plurality of jaws includes threads defined along an outer surface thereof. The outer collar includes at least one thread defined along an inner surface of the outer collar. Rotation of the outer collar relative to the inner collar causes the at least one outer collar thread to rotatably engage the inner collar threads and the plurality of jaws to deflect inward such that the plurality of jaws engages and compresses the electrical outlet when the electrical outlet is connected to the electrical plug.

In yet another aspect, a method of connecting an electrical outlet to a connector assembly includes connecting the electrical outlet to an electrical plug of the connector assembly. The connector assembly includes an inner collar having a plurality of jaws disposed circumferentially about the electrical plug, and an outer collar disposed radially outward from the inner collar. The method further includes rotating the outer collar relative to the inner collar such that at least one thread defined along an inner surface of the outer collar engages with threads defined along an outer surface of each of the plurality of jaws of the inner collar, and such that the plurality of jaws of the inner collar deflect inward to engage and compress the electrical outlet.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
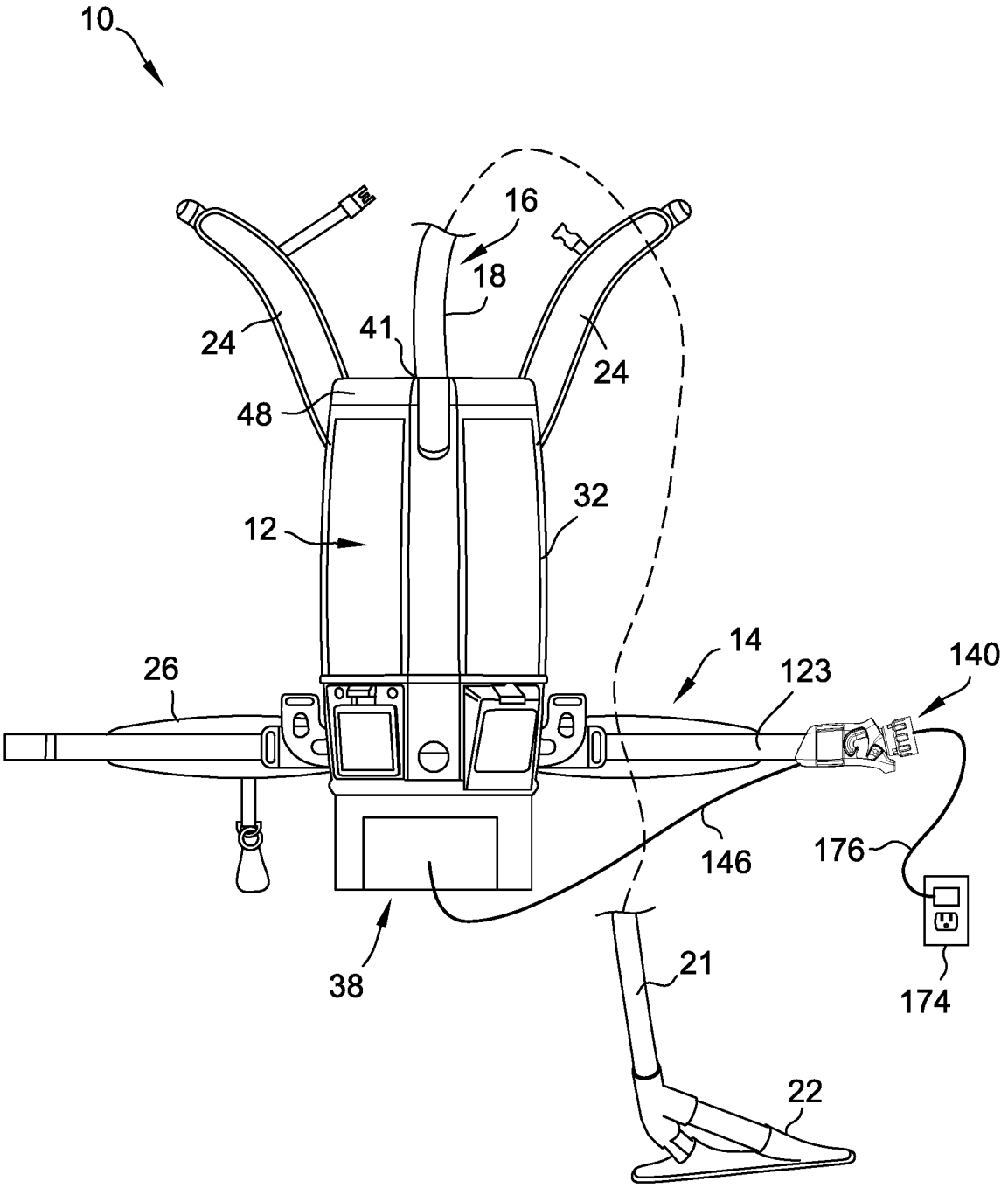
FIG. 1 is a perspective view of an example electrical appliance, illustrated in the form of a backpack vacuum cleaner, including a power cord restraint assembly.

FIG. 1 is a perspective view of an example electrical appliance 10, illustrated in the form of a corded backpack vacuum cleaner. Although the electrical appliance 10 is shown and described herein with reference to a backpack-mounted vacuum cleaner, electrical appliances consistent with this disclosure may be embodied in other types and in other combinations including, for example and without limitation, wet/dry vacuum cleaners, canister vacuum cleaners, upright vacuum cleaners, blowers, sprayers, and power tools and equipment.

In the example embodiment, the electrical appliance 10 includes a vacuum cleaner assembly 12 that is carried on a user's back via a harness or backpack assembly 14, and a vacuum conduit 16 connected to the vacuum cleaner assembly 12. The vacuum conduit 16 can generally include any suitable conduit for directing suction and/or forced air generated by the electrical appliance 10, including, for example and without limitation, vacuum hoses, vacuum wands or tubes, surface cleaning tools, and combinations thereof. In the illustrated embodiment, the vacuum conduit 16 includes a hose 18 extending from a top of the vacuum cleaner assembly 12, a vacuum cleaner wand 21 connected to the hose 18, and a vacuum cleaner floor tool 22 connected to a distal end of the wand 21.

The backpack assembly 14 is sized and shaped to be worn by a user of the electrical appliance 10 (e.g., on the user's back or shoulders) to facilitate carrying the electrical appliance 10 during use. In the illustrated embodiment, the backpack assembly 14 includes two shoulder straps 24 and a waist belt 26 for securing the backpack assembly 14 and electrical appliance 10 to the torso of a user. In other embodiments, the backpack assembly 14 can have any suitable configuration that enables the electrical appliance 10 to function as described herein.

Figure 2:
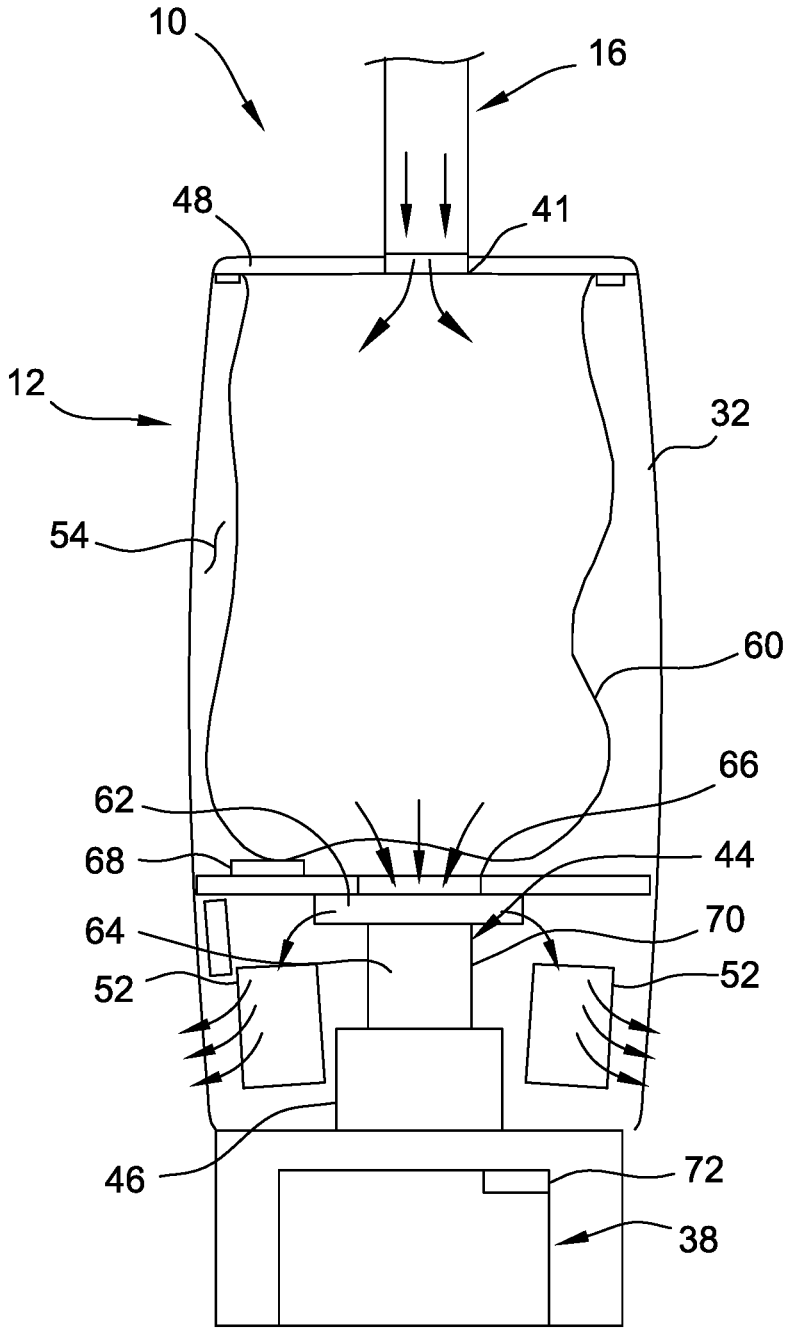
FIG. 2 is a side schematic view of the electrical appliance shown in FIG. 1.
Figure 3:
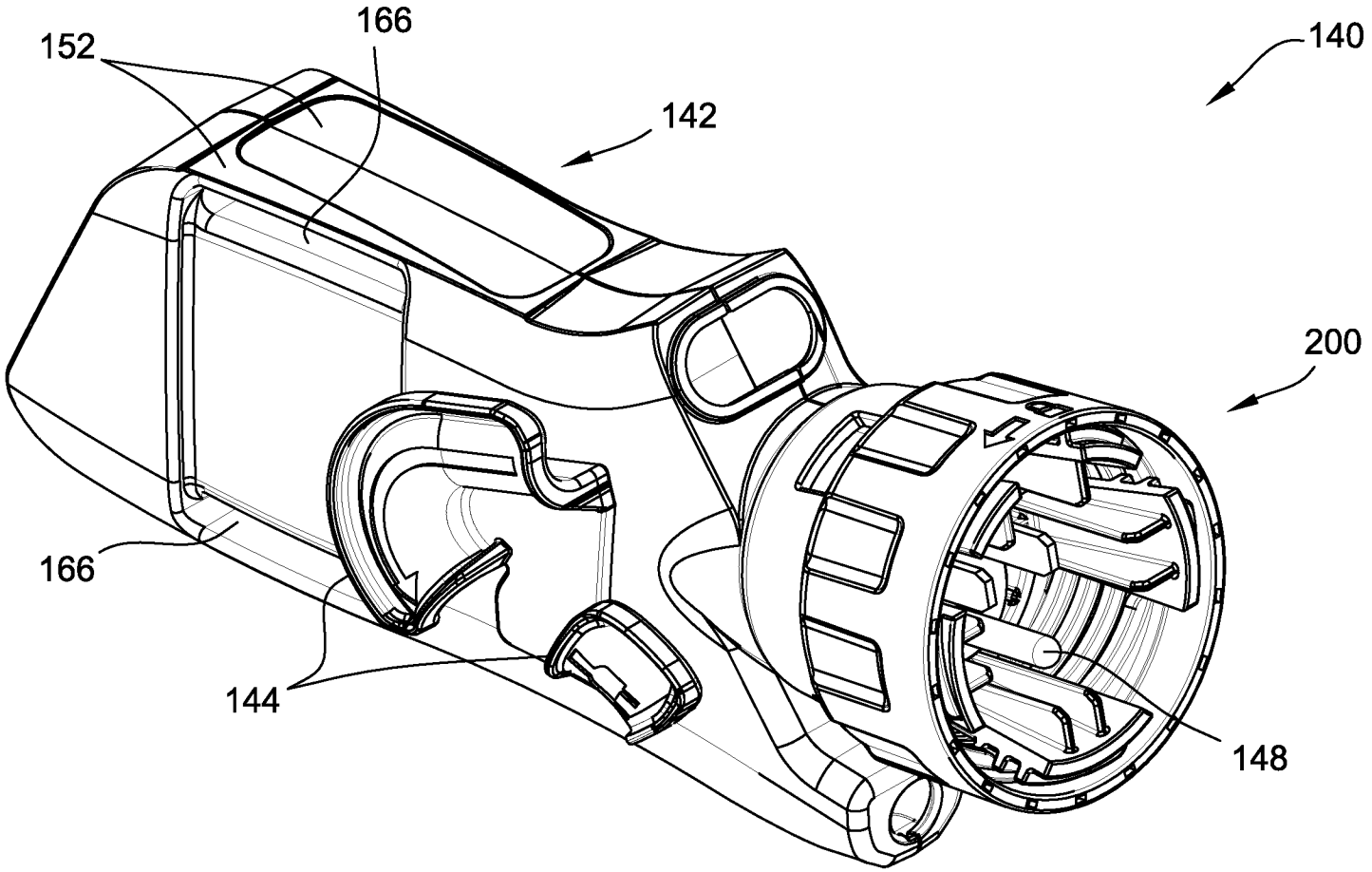
FIG. 3 is a perspective view of the power cord restraint assembly shown in FIG. 1.
Figure 4:
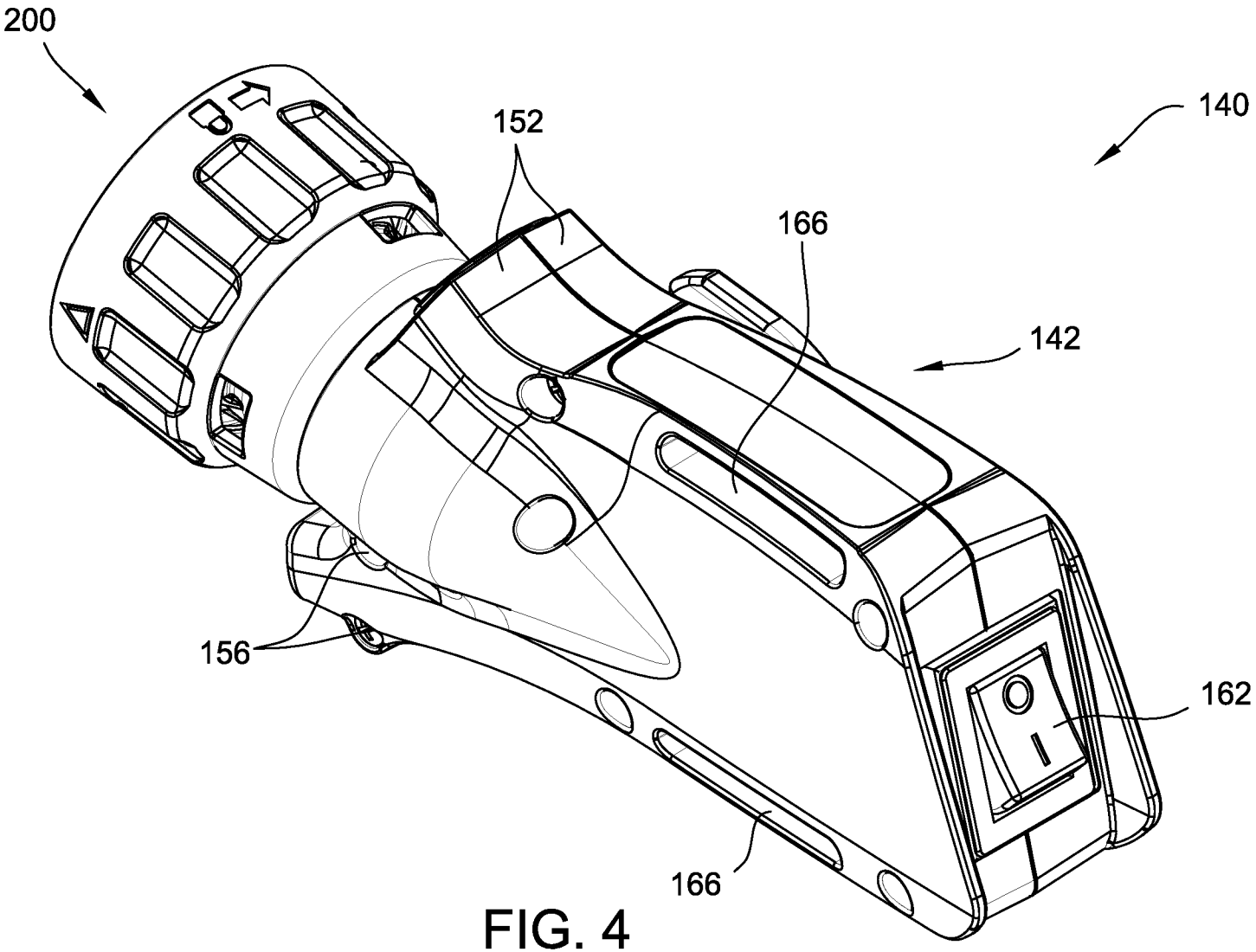
FIG. 4 is another perspective view of the power cord restraint assembly shown in FIG. 1.
Figure 5:
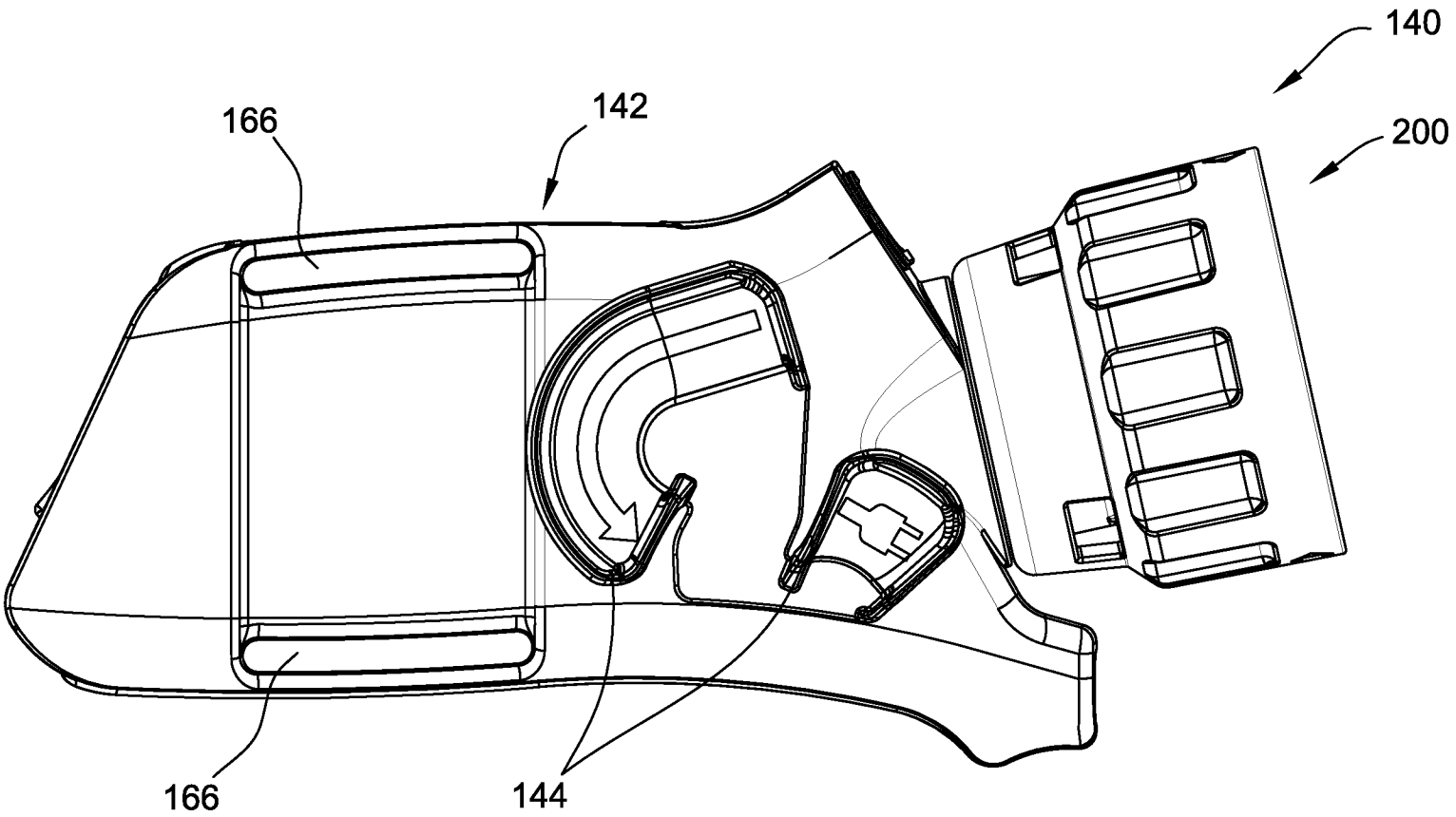
FIG. 5 is a front view of the power cord restraint assembly.
Figure 6:
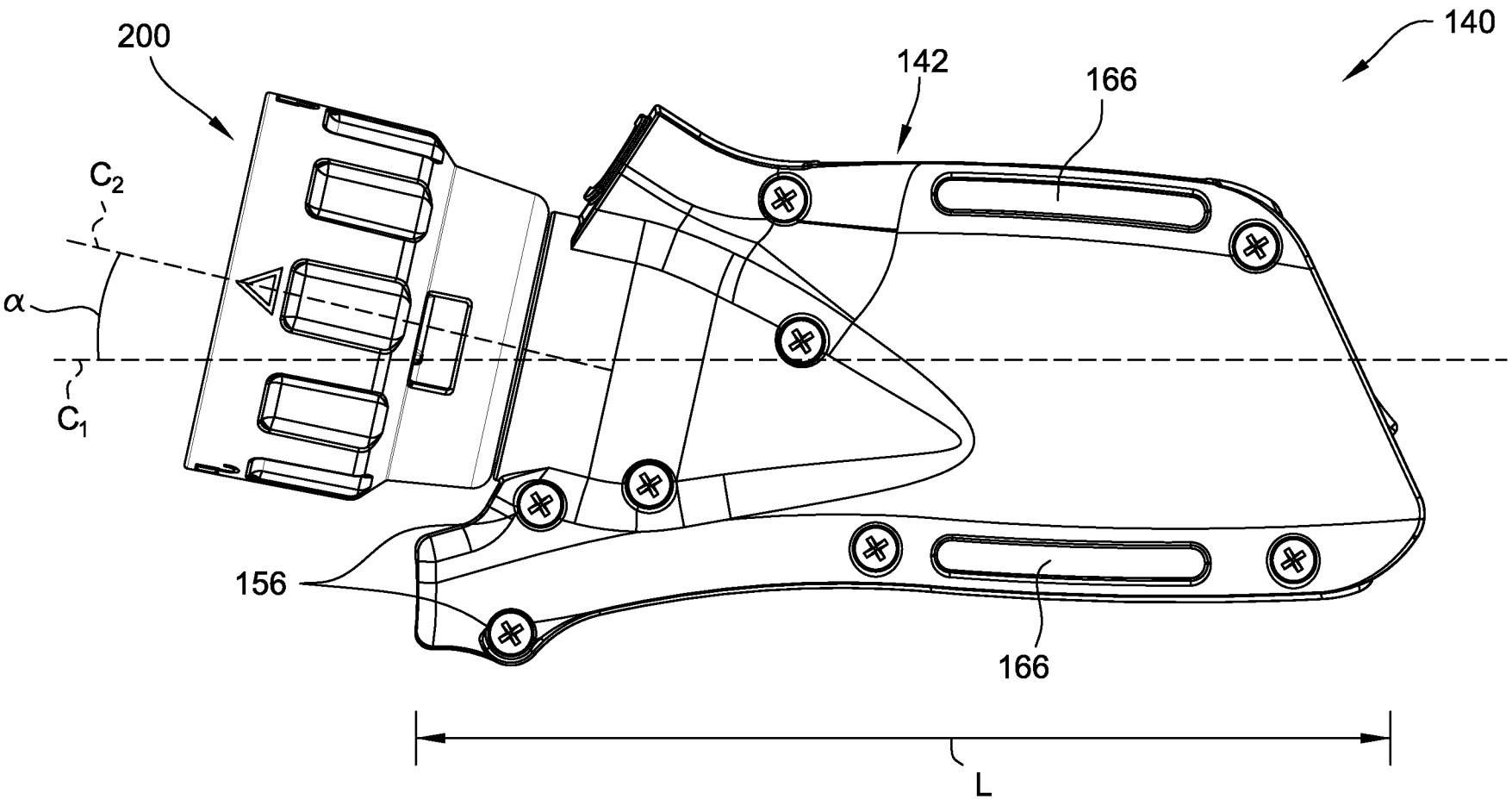
FIG. 6 is a back view of the power cord restraint assembly.
Figure 7:
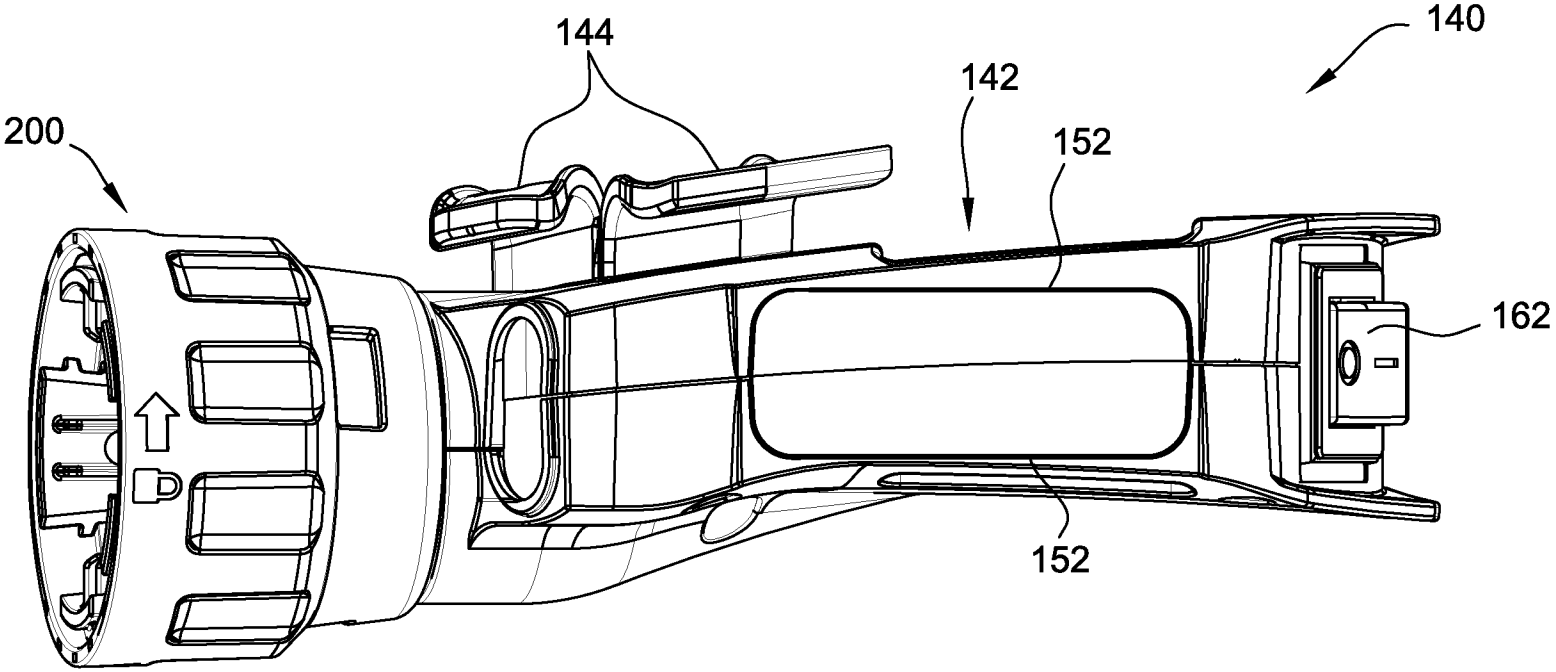
FIG. 7 is a top view of the power cord restraint assembly.
Figure 8:
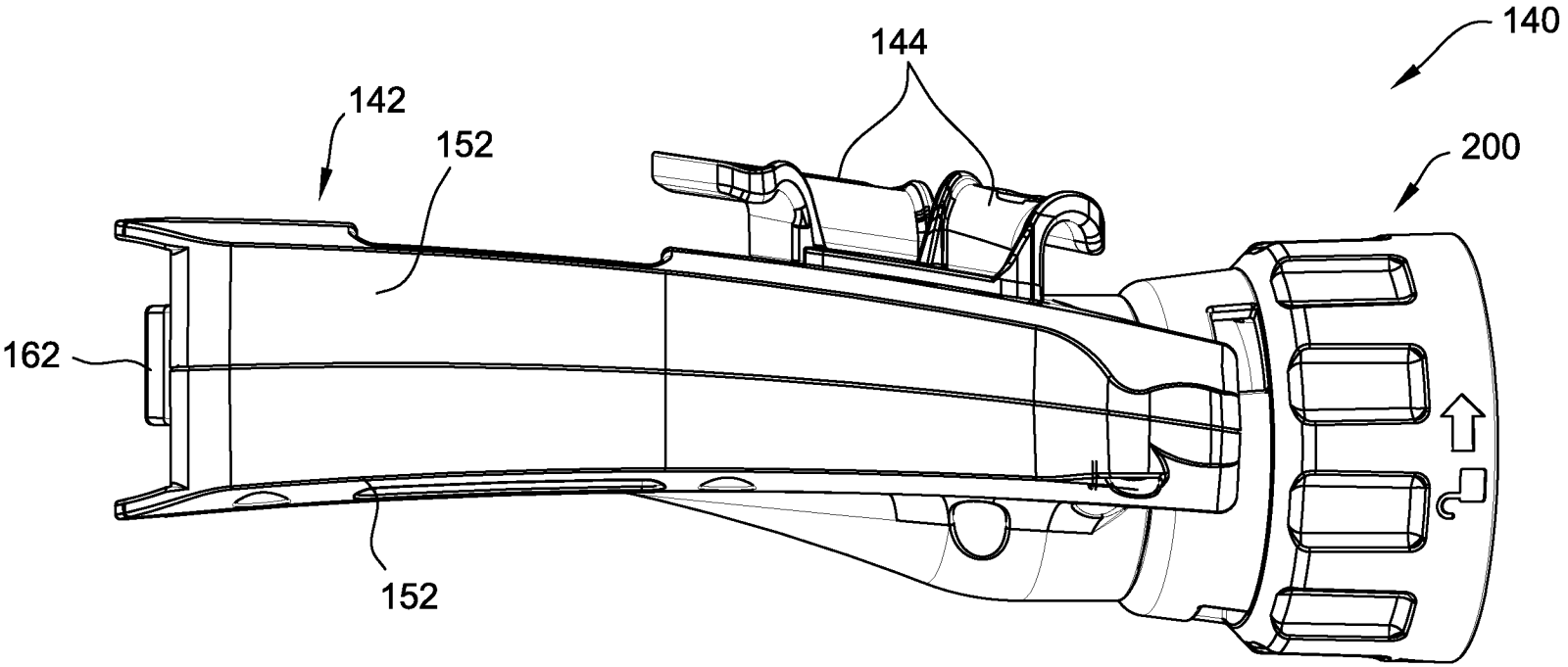
FIG. 8 is a bottom view of the power cord restraint assembly.

With additional reference to FIG. 2, the vacuum cleaner assembly 12 includes a vacuum cleaner housing 32, a suction unit 44 enclosed within the vacuum cleaner housing 32, and a controller 46. The vacuum cleaner housing 32 defines an inlet 41, at least one exhaust or outlet 52, and a debris chamber 54 connected in fluid communication between the inlet 41 and the outlet 52. In the example embodiment, the inlet 41 is defined at a top of the vacuum cleaner housing 32, and the vacuum cleaner housing 32 includes two outlets 52 defined adjacent a bottom of the vacuum cleaner housing 32. In other embodiments, the inlet 41 and the outlet(s) 52 can be defined at any suitable portion of the electrical appliance 10 that enables the electrical appliance 10 to function as described herein. Further, the electrical appliance 10 can include more than or fewer than two outlets 52.

In the illustrated embodiment, the vacuum cleaner housing 32 includes an access door or lid 48 that provides access to the debris chamber 54, for example, to empty debris collected within the debris chamber 54. The inlet 41 is defined in the lid 48 in the example embodiment. Further, the example vacuum cleaner housing 32 is adapted to receive a filter 60 within the debris chamber 54 to filter out fine debris and small particles from the air flow through the vacuum cleaner housing 32. In the illustrated embodiment, the filter 60 is a bag filter, although the electrical appliance 10 can be operable with other types of filters, including, for example and without limitation, cartridge filters.

The suction unit 44 is operable to generate airflow (indicated by arrows in FIG. 2) through the vacuum cleaner housing 32 from the inlet 41 to the outlet 52 so as to draw debris into the debris chamber 54 through the inlet 41 by way of the vacuum conduit 16 (shown in FIG. 1). The suction unit 44 includes a fan or impeller 62 and a motor 64 operatively connected to the impeller 62 (collectively referred to herein as a "motor assembly") to drive the impeller 62 and generate airflow through the vacuum cleaner housing 32. The motor assembly is connected to the vacuum cleaner housing 32 and positioned adjacent the debris chamber 54 such that the impeller 62 receives airflow through an impeller inlet 66 defined by the vacuum cleaner housing 32. In certain embodiments, the motor assembly can also be adapted to operate in a "reverse" mode in which the motor assembly generates airflow from the outlet 52 to the inlet 41, so as to enable the electrical appliance 10 to operate as a blower.

A suitable power source supplies electrical power to components of the electrical appliance 10, such as the motor 64 and the controller 46, and can generally include any suitable power source that enables the electrical appliance 10 to operate as described herein. Suitable types of power sources include, for example and without limitation, DC power sources, such as battery packs, and AC power sources, such as mains AC electricity from a household or commercial wall outlet. In the illustrated embodiment, the power source is an AC power source provided by a wall outlet 174, and the vacuum cleaner assembly 12 includes a power cord 146 with an electrical plug 148 disposed on an end thereof for electrical connection to the wall outlet. The power cord 146 is electrically connected to the electrical appliance 10 to supply AC power thereto. As described further herein, the electrical appliance 10 includes a power cord restraint assembly 140 attached to the backpack assembly 14 (e.g., by a strap 123, coupling link, or other suitable attachment mechanism) that facilitates maintaining connection between the power cord 146 of the electrical appliance 10 and an external power cord (e.g., an extension cord connected to a wall outlet).

The electrical appliance 10 can also include an on-board or portable power source 38, such as a battery or battery pack. In such embodiments, the power cord 146 can be used to supply AC power to the electrical appliance 10, which is converted to DC, to charge the battery, in addition to or as an alternative to supplying power to other components of the electrical appliance 10. In such embodiments, the electrical appliance 10 may be selectively operated in a cordless mode, in which the portable power source 38 is electrically connected to the electrical appliance 10, and a corded mode, in which the power cord 146 is electrically connected to the electrical appliance 10 and supplies AC power to the electrical appliance 10 (e.g., from a wall outlet). Other embodiments may be operated only from a battery or only from AC power.

The illustrated electrical appliance 10 also includes a plurality of sensors 68, 70, 72 connected to the controller 46. The sensors 68, 70, 72 can provide feedback to the controller 46 regarding operation of the electrical appliance 10, and the controller 46 can control the electrical appliance 10 based on feedback received from the sensors 68, 70, 72. Sensors 68, 70, 72 can include, for example and without limitation, proximity sensors, pressure sensors, temperature sensors, voltage sensors, and active or passive current sensors.

With additional reference to FIGS. 3-8, the power cord restraint assembly 140 includes a housing 142, a cord wrap fixture 144, and a connector assembly 200. In the illustrated embodiment, the housing 142 is assembled from two housing shells 152 that define a cavity (not shown) therein. The cavity is shaped and sized to receive the power cord 146 and electrical plug 148. In further embodiments, the housing 142 can also be assembled from a single housing shell 152, three housing shells 152, or any number of housing shells 152 that allows the power cord restraint assembly 140 to function as described herein. The housing shells 152 can be held together with screws 156, bolts, interlocking features disposed on the housing shells 152, or any other suitable attachment mechanism. The housing 142 defines a first centerline $C_1$ (FIG. 6) that extends at least across a length L of the housing 142. The housing 142 further defines one or more slots 166 extending through a width of the housing 142. The slots 166 are configured to receive the strap 123 (shown in FIG. 1), coupling link, or other suitable attachment mechanism for attaching the power cord restraint assembly 140 to the backpack assembly 14 of the electrical appliance 10.

The housing 142 further includes a power switch 162 (FIG. 4) electrically coupled to the electrical plug 148. The power switch 162 is operable to control the supply of power to the electrical appliance when the electrical plug 148 is connected to an electrical outlet 172 (shown in FIGS. 15 and 16), and when the electrical outlet 172 is connected to a power source 174 (FIG. 1). In some embodiments, the electrical outlet 172 can be disposed on an extension cord 176. In such embodiments, the cord wrap fixture 144 is configured to secure the extension cord 176 to the housing 142 by wrapping the extension cord 176 around the cord wrap fixture 144.

Figure 9:
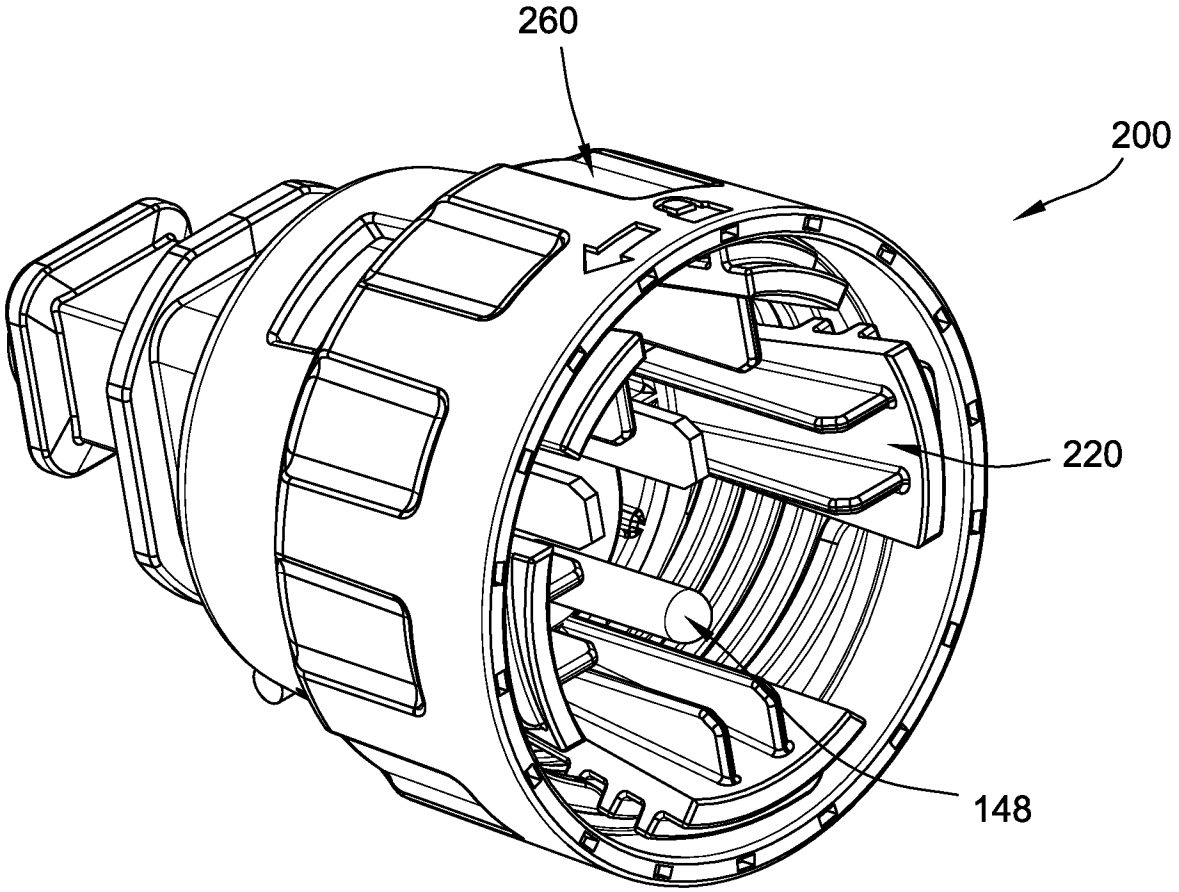
FIG. 9 is a perspective view of a connector assembly of the power cord restraint assembly shown in FIGS. 3-8.
Figure 10:
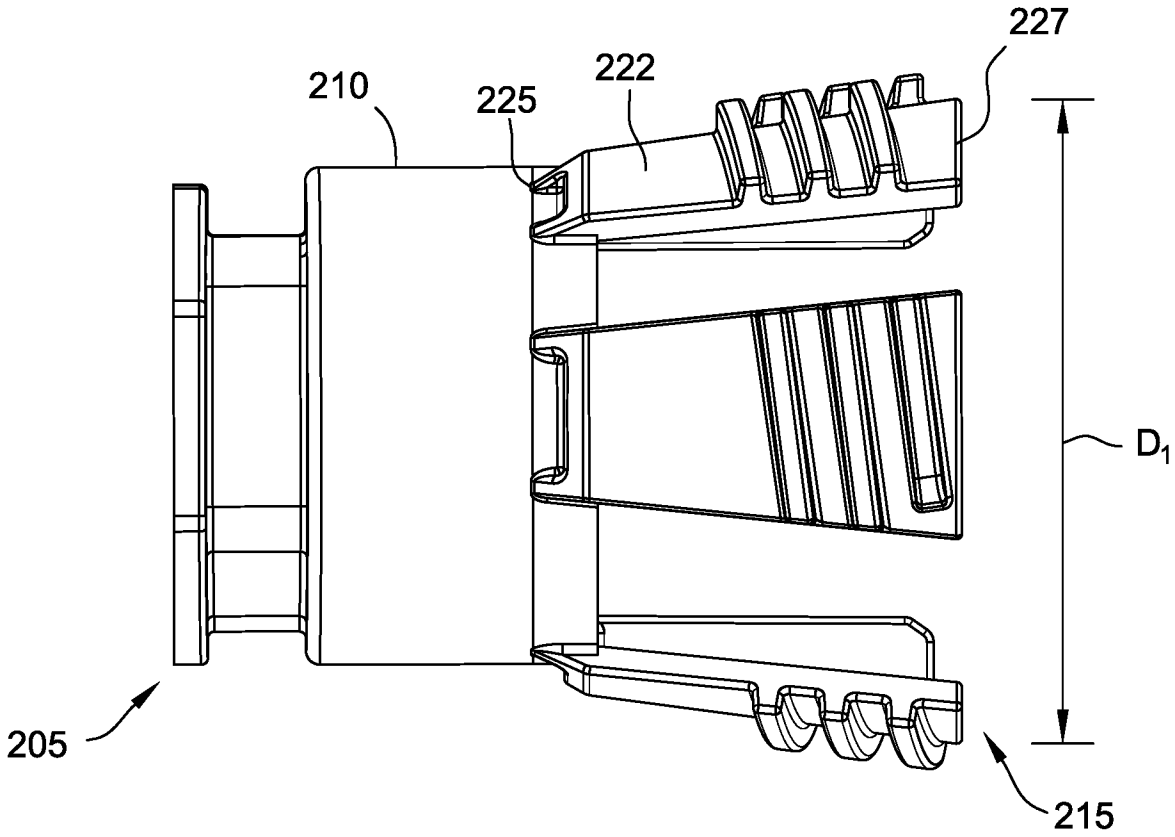
FIG. 10 is a front view of an inner collar of the connector assembly shown in FIG. 9.
Figure 11:
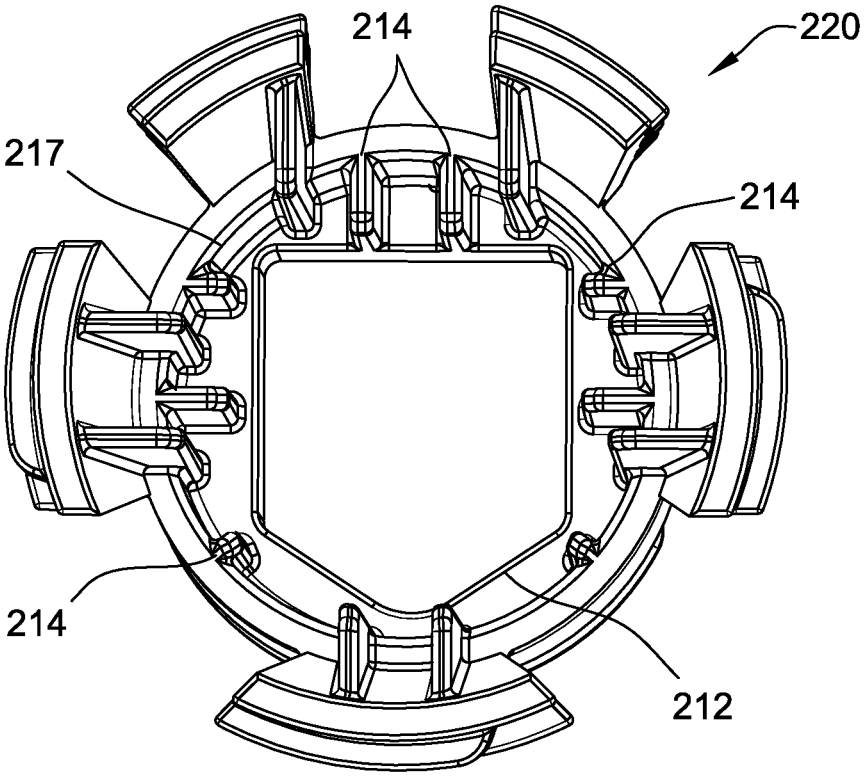
FIG. 11 is a side view of the inner collar shown in FIG. 10.
Figure 12:
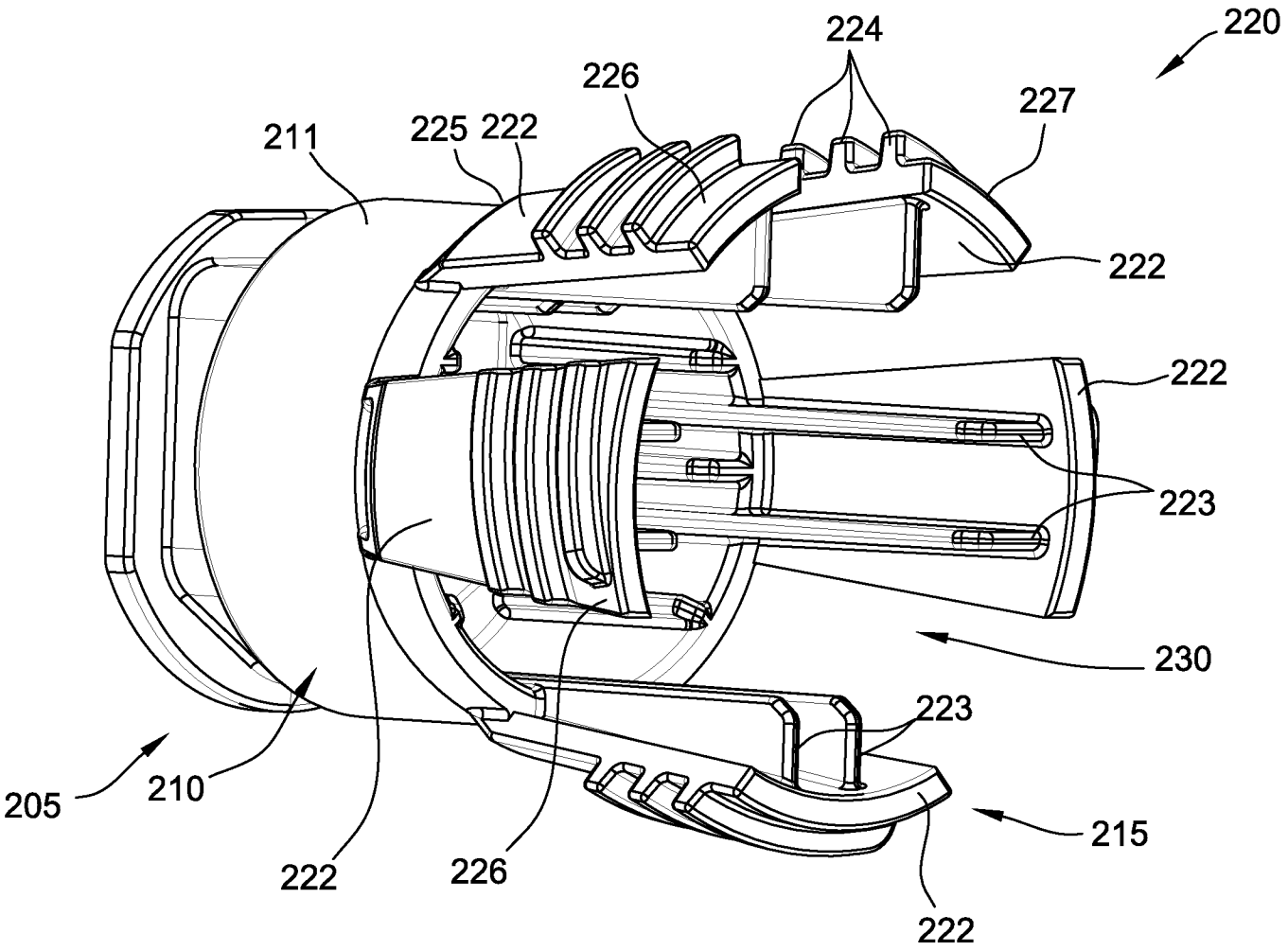
FIG. 12 is a perspective view of the inner collar.

With reference to FIG. 9, the connector assembly 200 includes the electrical plug 148, an inner collar 220, and an outer collar 260 disposed radially outward from the inner collar 220. The electrical plug 148, when connected to an electrical outlet (e.g., electrical outlet 172), is configured to supply power to the electrical appliance 10. The inner collar 220, shown in more detail in FIGS. 9-11, extends from a first end 205 to a second end 215. A second centerline $C_2$ of the connector assembly 200 (FIG. 6) extends through the first end 205 and the second end 215. The first centerline $C_1$ of the housing 142 and the second centerline $C_2$ of the connector assembly 200 define an offset angle $\alpha$ (shown in FIG. 6). In some embodiments, the offset angle $\alpha$ is between 10 degrees and 20 degrees.

The inner collar 220 includes a base portion 210 disposed adjacent the first end 205. The base portion 210 defines an opening 212 (FIG. 11) through which the electrical plug 148 is received when the connector assembly 200 is assembled. The inner collar 220 also includes a plurality of base protrusions 214 disposed around and extending radially inward from a radial inner surface 217 of the base portion 210. The base protrusions 214 engage the electrical plug 148 when inserted through the opening 212 to help secure the electrical plug 148 to the connector assembly 200.

The inner collar 220 also includes a plurality of jaws 222 extending from the base portion 210 to the second end 215 of the inner collar 220. The jaws 222 are arranged circumferentially about the second centerline $C_2$, and each jaw 222 is spaced circumferentially from adjacent jaws 222. Each jaw 222 extends from a first end 225 connected to the base portion 210, to a second, free end 227 disposed at the second end 215 of the inner collar 220.

In the illustrated embodiment, the inner collar 220 includes five jaws 222, though the inner collar 220 can include any suitable number of jaws that enables the connector assembly to function as described herein, including, for example and without limitation, two, three, four, or more jaws 222. Each of the jaws 222 includes threads 224 defined along a radial outer surface 226 of the jaw 222. Each jaw 222 can also include at least one protrusion 223 extending radially inward from the jaw 222. In the illustrated embodiment, each jaw 222 includes two protrusions 223, although other embodiments may have greater than or less than two protrusions 223 extending from each jaw 222.

Each jaw 222 has a suitably resilient construction such that the jaws 222 are capable of deflecting radially inward and/or outward in the presence of an applied force, and returning to an initial, undeflected position without undergoing permanent deformation when the force is removed. In the illustrated embodiment, for example, each jaw 222 is constructed of a resilient plastic and is connected or secured to the inner collar 220 only at one end (i.e., at the first end 225) such that the other end of the jaw 222 (i.e., the second end 227) is free to move or deflect radially inward and/or outward.

When assembled, the plurality of jaws 222 are disposed circumferentially about the electrical plug 148 and define an inner chamber 230 for receiving the electrical outlet 172 therein. The second end 215 is open and is sized to receive the electrical outlet 172. Each of the plurality of jaws 222 tapers radially outward from the first end 225 or base portion 210 to the second end 215 of the inner collar 220 such that a diameter $D_1$ (FIG. 10) of the inner chamber 230 increases from the first end 205 to the second end 215.

Figure 14:
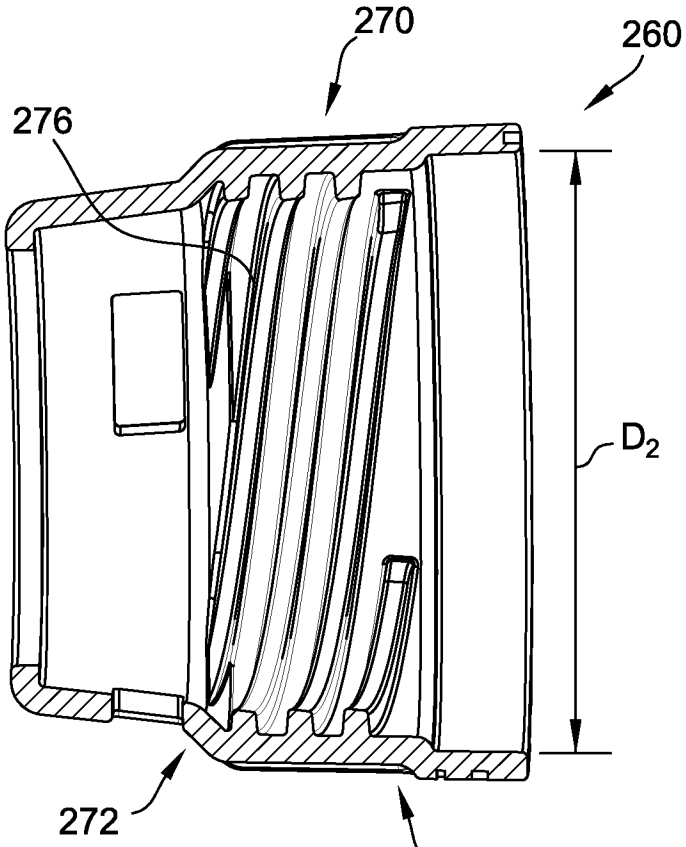
FIG. 14 is a cross-sectional view of the outer collar taken along line 14-14 in FIG. 13.
Figure 13:
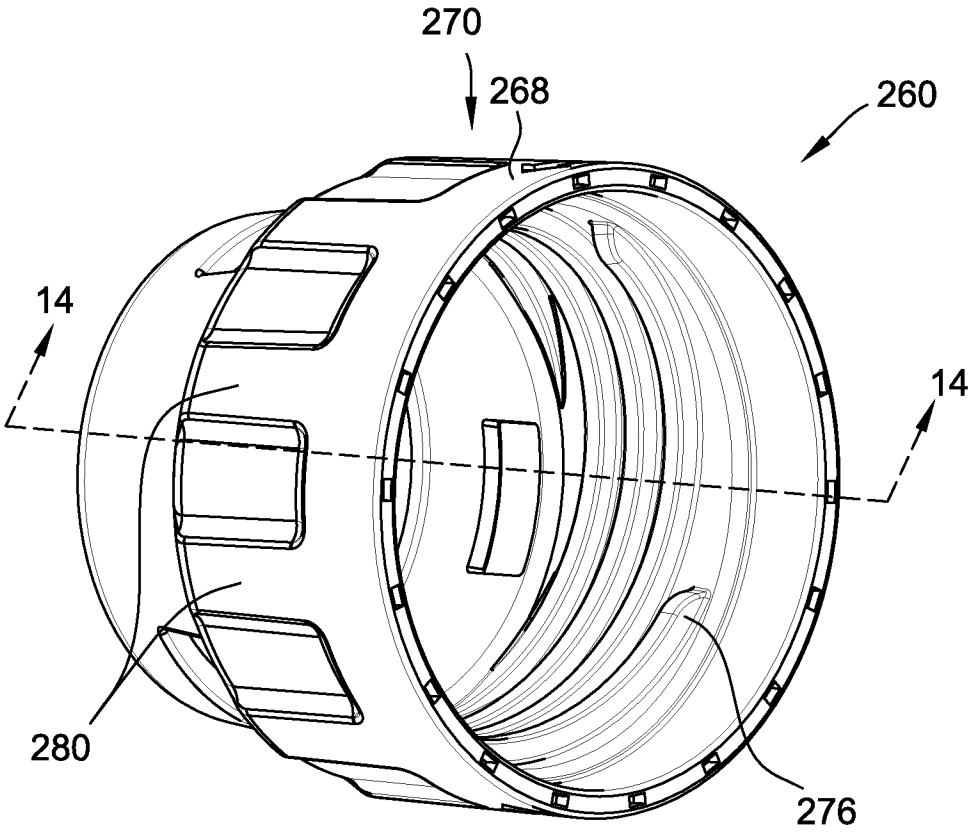
FIG. 13 is a perspective view of an outer collar of the connector assembly shown in FIG. 9.

With additional reference to FIGS. 13 and 14, the outer collar 260 includes a threaded portion 270 having at least one thread 276 defined along a radial inner surface 264 of the outer collar 260. The thread or threads 276 are configured to threadably engage the threads 224 of the jaws 222. The thread or threads 276 extend from a first end 272 of the threaded portion 270 to a second end 274 of the threaded portion 270. A diameter D2 of the threaded portion 270 is substantially constant from the first end 272 to the second end 274 in the illustrated embodiment, and the threaded portion 270 is substantially cylindrical. In other embodiments, the diameter D2 of the threaded portion 270 may be tapered. The outer collar 260 includes a radial outer surface 268 that is ergonomically shaped and/or textured to facilitate gripping the outer collar 260. In the illustrated embodiment, the radial outer surface 268 includes tactile ridges 280 disposed circumferentially about the outer collar 260 to facilitate gripping the outer collar 260. Additionally or alternatively, the radial outer surface 268 can include stippling, knurling, abrasive surfaces, combinations thereof, or any other suitable ergonomic shape or texture that facilitates gripping the outer collar 260.

The outer collar 260 and inner collar 220 are connected to one another using suitable connection means including, for example and without limitation, interlocking connectors or fasteners (e.g., clips or snaps), a press-fit or friction-fit connection, threads, and combinations thereof. In some embodiments, for example, the outer collar 260 can include one or more ribs or protrusions (not shown) defined along the inner surface 264 that are received within corresponding circumferential channels (not shown) defined along an outer surface 211 of the base portion 210 to connect the outer collar 260 to the inner collar 220.

Figure 15:
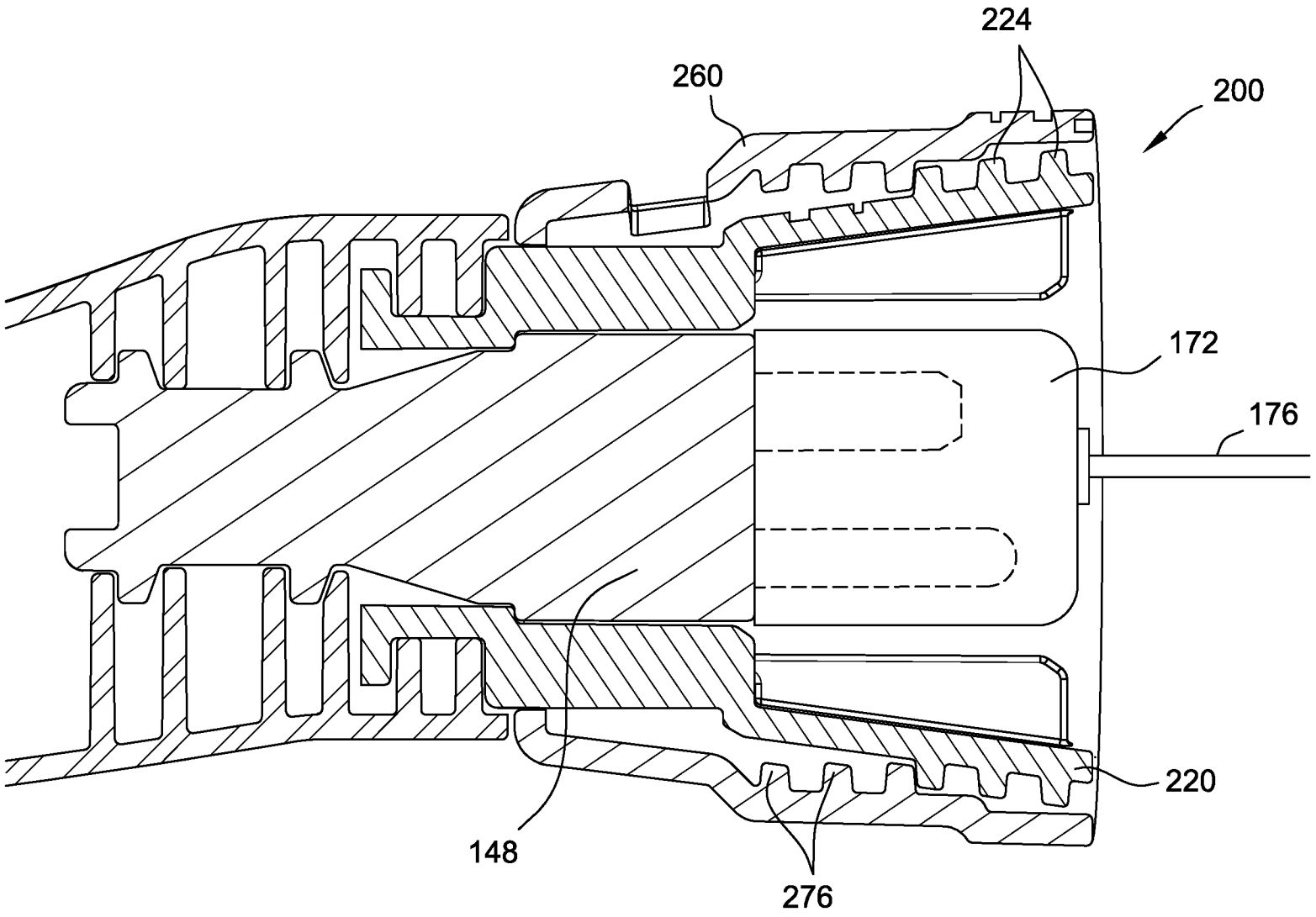
FIG. 15 is a cross-sectional view of the connector assembly show in FIG. 9 connected to an electrical outlet in an unlocked configuration.

FIG. 15 is a cross-sectional view of the connector assembly 200 in an unlocked configuration. The electrical plug 148 is electrically coupled to an electrical outlet 172 disposed on an end of an extension cord 176. As shown in FIG. 15, the outer collar 260 is disposed radially outward from the inner collar 220. When the connector assembly 200 is in the unlocked configuration, the jaws 222 are disposed in an initial, undeflected position, and the electrical plug 148 and electrical outlet 172 are connectable to and disconnectable from one another. The inner collar threads 224 and the outer collar threads 276 can be fully uncoupled and unthreaded from one another in the unlocked configuration, or the inner collar threads 224 and the outer collar threads 276 can remain partially coupled or threaded in the unlocked configuration.

Figure 16:
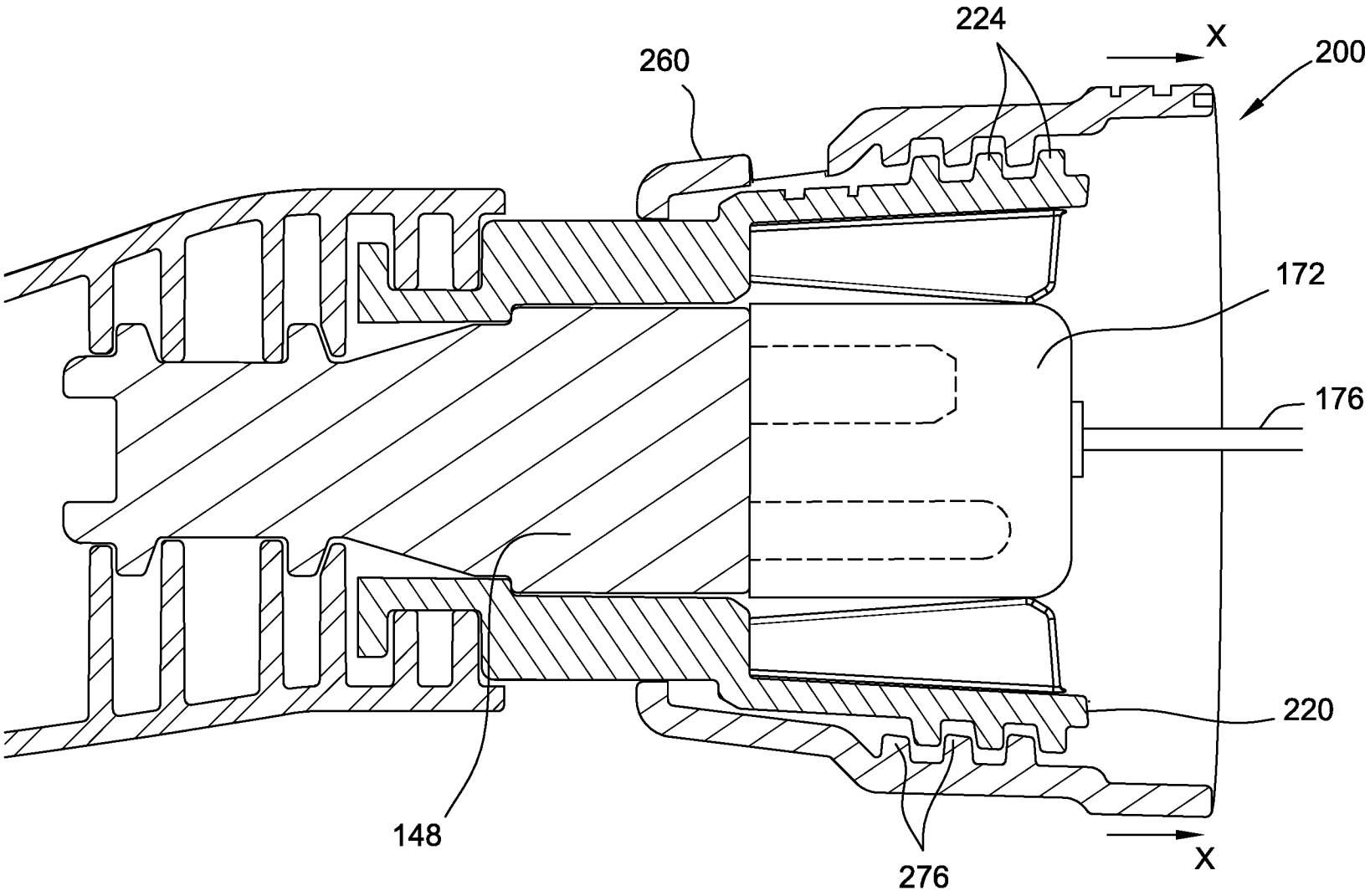
FIG. 16 is a cross-sectional view of the connector assembly shown in FIG. 9 connected to the electrical outlet in a locked configuration.

The connector assembly 200 can be transitioned from the unlocked configuration to a locked configuration by rotating the outer collar 260 relative to the inner collar 220 in a first direction. The locked configuration of the connector assembly 200 is shown in FIG. 16. Rotation of the outer collar 260 relative to the inner collar 220 in the first direction causes the outer collar threads 276 to threadably engage the inner collar threads 224. As the threads 224 and 276 engage one another, the outer collar 260 translates relative to the inner collar 220 in an axial direction, indicated by arrow x in FIG. 16. As the outer collar 260 translates, the outer collar 260 engages the jaws 222 and pushes the jaws 222 radially inward, causing the jaws 222 to deflect radially inward to conform to the substantially cylindrical shape of the threaded portion 270 of the outer collar 260. As the jaws 222 deflect radially inward, they engage and compress the electrical outlet 172 to restrict movement of the electrical outlet 172 and thereby facilitate maintaining engagement between the electrical outlet 172 and the electrical plug 148. In the illustrated embodiment, the protrusions 223 extending radially inward from each jaw 222 engage and compress the electrical outlet 172.

An example method of connecting the electrical outlet 172 to the connector assembly 200 includes connecting the electrical outlet 172 to the electrical plug 148 of the connector assembly 200, and rotating the outer collar 260 relative to the inner collar 220 in a first direction such that the outer collar threads 276 engage with the inner collar threads 224, and such that the plurality of jaws 222 of the inner collar 220 deflect inward (e.g., radially inward) to engage and compress the electrical outlet 172. In embodiments where each of the plurality of jaws 222 includes one or more protrusions 223, rotating the outer collar 260 relative to the inner collar 220 can include rotating the outer collar 260 such that the at least one protrusion 223 of each of the plurality of jaws 222 engages and compresses the electrical outlet.

The method can also include activating the power switch 162 to supply power to the electrical appliance 10, and/or deactivating the power switch 162 to suspend the supply of power to the electrical appliance 10.

In embodiments where the connector assembly 200 includes a cord wrap fixture 144, the method can include securing the extension cord 176 to the fixture 144.

In embodiments where the inner collar includes one or more circumferential channels defined along the outer surface 211 of the base portion 210 and the outer collar 260 includes one or more corresponding ribs defined along the inner surface 264, the method can include rotating the outer collar 260 relative to the inner collar 220 such that each of the ribs is received in a corresponding one of the circumferential channels.

In some embodiments, the method includes rotating the outer collar 260 in a second direction opposite the first direction such that the outer collar threads 276 unthread from the inner collar threads 224 and the plurality of jaws 222 move outward (e.g., radially outward) to release the electrical outlet 172. The method can also include disconnecting the electrical outlet 172 from the electrical plug 148.

Embodiments of the connector assemblies described herein provide several advantages over prior designs. For example, connector assemblies of the present disclosure can be used with common or standard plugs and power outlets without the need for specialized features or additional hardware. Specifically, embodiments of the connector assemblies include an integrated locking mechanism in the form of cooperating inner and outer collars that secure an electrical cord outlet to a plug of the connector assembly. Additionally, embodiments of the connector assemblies include inner and outer collars that substantially or fully encase the connection between the plug and outlet, thereby shielding the user from any thermal events during connection or operation. In addition, connector assemblies of the present disclosure can be quickly and easily integrated into existing electrical appliances, such as backpack vacuum cleaners. For example, embodiments of the connector assemblies include a housing that defines slots designed to receive a connection strap to secure the connector assembly to an electrical appliance. Additionally, embodiments of cord restraint assemblies described herein can facilitate reducing side-to-side stress on the cord restraint assembly, for example, by including a cord restraint fixture on the housing that secures a portion of a power or extension cord thereto.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A connector assembly comprising:

an electrical plug connectable to an electrical outlet;

an inner collar comprising a plurality of jaws disposed circumferentially about the electrical plug, wherein each jaw of the plurality of jaws includes threads defined along an outer surface of each jaw; and an outer collar disposed radially outward from the inner collar, the outer collar comprising at least one thread defined along an inner surface of the outer collar;

wherein rotation of the outer collar relative to the inner collar causes the at least one outer collar thread to rotatably engage the inner collar threads and the plurality of jaws to deflect inward such that the plurality of jaws engages and compresses the electrical outlet when the electrical outlet is connected to the electrical plug.

2. The connector assembly of claim 1, wherein each jaw of the plurality of jaws further comprises at least one protrusion extending radially inward from the jaw, wherein the at least one protrusion of each of the plurality of jaws engages and compresses the electrical outlet when the jaws deflect inward.

3. The connector assembly of claim 1, wherein the outer collar further comprises an outer surface that is at least one of ergonomically shaped or textured to facilitate gripping the outer collar.

4. The connector assembly of claim 1, wherein the inner collar extends from a first end to a second, open end sized to receive the electrical outlet, the plurality of jaws defining an inner chamber for receiving the electrical outlet therein, wherein each of the plurality of jaws tapers outward towards the second end of the inner collar such that a diameter of the inner chamber increases from the first end to the second end.

5. The connector assembly of claim 1, wherein the inner collar extends from a first end to a second, open end sized to receive the electrical outlet, the inner collar further comprising a base portion disposed adjacent the first end, wherein the base portion defines an opening shaped and sized to receive the electrical plug, the base portion comprising a plurality of protrusions disposed around an inner surface of the base portion, the plurality of protrusions engaging the electrical plug to secure the electrical plug in place.

6. The connector assembly of claim 1, wherein the inner collar extends from a first end to a second, open end sized to receive the electrical outlet, the inner collar further comprising a base portion disposed adjacent the first end, wherein each of the plurality of jaws is connected to the base portion at a first end and extends to a second, free end configured to deflect inward.

7. The connector assembly of claim 1, wherein each jaw of the plurality of jaws is spaced circumferentially from adjacent jaws.

8. A system comprising:

an electrical appliance comprising an electrical plug configured to supply power to the electrical appliance when connected to an electrical outlet; and a connector assembly comprising:

an inner collar comprising a plurality of jaws disposed circumferentially about the electrical plug, wherein each jaw of the plurality of jaws includes threads defined along an outer surface thereof; and an outer collar disposed radially outward from the inner collar, the outer collar comprising at least one thread defined along an inner surface of the outer collar;

wherein rotation of the outer collar relative to the inner collar causes the at least one outer collar thread to rotatably engage the inner collar threads and the plurality of jaws to deflect inward such that the plurality of jaws engages and compresses the electrical outlet when the electrical outlet is connected to the electrical plug.

9. The system of claim 8 wherein the electrical appliance is a backpack vacuum cleaner.

10. The system of claim 8 further comprising a connector assembly housing, the connector assembly connected to the connector assembly housing, wherein the connector assembly housing comprises a power switch operable to control the supply of power to the electrical appliance when the electrical plug is connected to the electrical outlet.

11. The system of claim 10, wherein the connector assembly housing includes a cord wrap fixture configured to secure an extension cord connected to the electrical outlet.

12. The system of claim 10, wherein the connector assembly housing defines a first centerline extending along a length of the connector assembly housing, wherein the connector assembly defines a second centerline extending from a first end to a second end of the inner collar, and wherein the first centerline and the second centerline are oriented an offset angle relative to one another.

13. The system of claim 12, wherein the offset angle is between 10 degrees and 20 degrees.

14. A method of connecting an electrical outlet to a connector assembly, the method comprising:

connecting the electrical outlet to an electrical plug of the connector assembly, the connector assembly including an inner collar having a plurality of jaws disposed circumferentially about the electrical plug and an outer collar disposed radially outward from the inner collar; and rotating the outer collar relative to the inner collar such that at least one thread defined along an inner surface of the outer collar engages with threads defined along an outer surface of each of the plurality of jaws of the inner collar, and such that the plurality of jaws of the inner collar deflect inward to engage and compress the electrical outlet.

15. The method of claim 14, wherein each of the plurality of jaws includes at least one protrusion extending radially inward from the jaw, wherein rotating the outer collar relative to the inner collar causes the at least one protrusion of each of the plurality of jaws to engage and compress the electrical outlet.

16. The method of claim 14, wherein the electrical plug is electrically connected to a power switch, the method further comprising activating the power switch to supply power to an electrical appliance.

17. The method of claim 16 further comprising deactivating the power switch to suspend the supply of power to the electrical appliance.

18. The method of claim 14, wherein the connector assembly is connected to a connector assembly housing including a cord wrap fixture, and wherein the electrical outlet is coupled to an end of an extension cord, the method further comprising securing the extension cord to the cord wrap fixture.

19. The method of claim 14, wherein rotating the outer collar relative to the inner collar includes rotating the outer collar in a first direction, the method further comprising rotating the outer collar in a second direction opposite the first direction such that the at least one outer collar thread unthreads from the inner collar threads and the plurality of jaws move outward to release the electrical outlet.

20. The method of claim 19 further comprising disconnecting the electrical outlet from the electrical plug.

* * * * *